US005439375A

United States Patent [19]

Wang

[11] Patent Number: 5,439,375

[45] Date of Patent: Aug. 8, 1995

[54] CHILD-RESISTANT LOCKABLE LIGHTER

[75] Inventor: Zhengge Wang, Vancouver, Canada

[73] Assignee: American Tectrade Enterprises, Inc., Vancouver, Canada

[21] Appl. No.: 260,806

[22] Filed: Jun. 16, 1994

[51] Int. Cl.[6] ..... F23D 11/36

[52] U.S. Cl. ..... 431/153; 431/277

[58] Field of Search ..... 431/153, 253, 129, 277

[56] References Cited

U.S. PATENT DOCUMENTS

| | | | |
|---|---|---|---|
| 4,717,335 | 1/1988 | Loveless | 431/277 |
| 5,085,578 | 2/1992 | Hunter | 431/277 |
| 5,145,358 | 9/1992 | Shike et al. | 431/277 X |
| 5,213,495 | 5/1993 | Pan | 431/153 X |
| 5,236,351 | 8/1993 | Tien | 431/277 |
| 5,271,731 | 12/1993 | Hsin-Chung | 431/277 X |
| 5,324,193 | 6/1994 | Pan | 431/153 |

FOREIGN PATENT DOCUMENTS

| | | | |
|---|---|---|---|
| 2269003 | 1/1994 | United Kingdom | 431/153 |

*Primary Examiner*—Carl D. Price

*Attorney, Agent, or Firm*—Brian M. Long

[57] ABSTRACT

A child-resistant lockable lighter has an actuating lever which can be slid to and fro between a locked position and a released position. In its released position, the lever is pivotable for opening a gas valve. In its locked position, the lever is prevented from pivoting and, also is wedged against the side wheels of the spark wheel so as to prevent rotation of the spark wheel. The pulling force required to displace the locking lever from its locked position to its released position is greater than that which can be exerted by a child.

6 Claims, 4 Drawing Sheets

CHILD-RESISTANT LOCKABLE LIGHTER

BACKGROUND OF THE INVENTION

1. Field of the Invention

The present invention relates to lighters and, more particularly, to child-resistant lockable lighters.

2. Description of the Related An

Prior art child-resistant cigarette lighters and safety lighters have the following drawbacks:

1. They have locking mechanisms which are very complicated and the locking reliability of which is not high.

For example, U.S. Pat. No. 5,271,731, issued to Pan Hsim-Chung on Dec. 21, 1993, discloses an automatically lockable safety lighter which has a very complicated actuating lever and top frame. When a child plays with this prior lighter, the actuating lever may still be pushed forwardly to a released condition, and the lighter may ignite. The mechanism of this prior lighter may be permit a spark wheel of an igniting means to be rotated, thus producing sparks, which could result in ignition of an inflammable substance other than the fuel of the lighter.

2. U.S. Pat. No. 5,236,351, issued Aug. 17, 1993 to Andrew, discloses a safety interlock for a cigarette lighter which has a very complicated safety interlocking means. A safety handle leaf spring is mounted on the lighter on the exterior of a lighter case and can be inadvertently displaced into a released position, thus resulting in the lighter being ignited, and also normal igniting operation may be obstructed when such a lighter is used. Also, inconvenience may be caused when storing or handling such a lighter, because of its large volume, which requires additional space for such a specially-constructed lighter, for example in a purse or a pocket.

The prior locking mechanisms are difficult to manufacture and, in fact, some cannot even be manufactured. For example, the top frame disclosed in the aforesaid U.S. Pat. No. 5,271,731 cannot be manufactured, because a guide slot on the inside of the top frame cannot be moulded or milled, since a core cannot be taken out of the top frame after moulding and, in the case of milling, the milling cutter cannot be advanced. A leaf spring and a guide sheath disclosed in the aforesaid U.S. Pat. No. 5,236,351 are also difficult to manufacture.

Owing to the fact that the prior art locking mechanisms are very complicated and hard to manufacture, the cost of production is correspondingly high.

SUMMARY OF THE INVENTION

It is accordingly an object of the invention to provide a novel and reliable child-resistant lockable lighter.

It is a further object of the present invention to provide a lighter which mitigates the abovedescribed disadvantages of prior art lighters, and which incorporates an actuating lever as part of a locking mechanism which can be operated to lock the actuating lever and, also, to lock a spark wheel, the locking mechanism being of simple construction which is easy and inexpensive to manufacture.

It is a still further object of the present invention to provide a child-resistant lockable lighter which does not require additional components for locking the lighter, such as a restoring spring or a wheel interlock tooth.

According to the present invention, there is provided a child-resistant lockable lighter which has a cover on a fuel tank, with a valve mounted on the cover, the valve including a gas outlet nozzle for the outflow of gas from the tank under the control of the valve. The lighter includes a spark wheel, a flint and a spring urging the flint against the spark wheel to produce a spark on rotation of the spark wheel. For operating the valve, a lever is pivotable about a fulcrum. The lever is displaceable between a locked position, in which the lever maintains the valve in a closed condition, and a released position, in which the lever is free to pivot about the fulcrum to thereby open the valve.

When the lever is in its locked position, an abutment formed on the tank cover engages the lever and prevents pivotation of the lever about the fulcrum.

In the preferred embodiment of the invention, the lever is longitudinally horizontally slidable between the locked position and the released position and, in the locked position, the lever is wedged against the spark wheel and thereby prevents rotation of the spark wheel.

When the lighter is in use, the user needs only to push the lever horizontally from its released position to its locked position in order to ensure that the lighter cannot ignite. When it is required to ignite the lighter, the user simply pulls the lever from its locked position to its released position, and then operates the lighter in a normal manner.

The manner of sliding the lever to and fro between its locked position and its released position are beyond the cognizance of a child. Therefore, a child cannot find out how to operate the lighter when it plays with the lighter. If the child accidentally, or in imitation of an adult, attempts to pull the lever into its released position, then the child cannot exert sufficient finger gripping and pulling forces on the lever in order to displace the lever.

BRIEF DESCRIPTION OF THE DRAWINGS

Further objects, features and advantages of the present invention will be more readily apparent from the following detailed description thereof given, by way of example, with reference to the accompanying drawings, in which.

DESCRIPTION OF THE PREFERRED EMBODIMENT

Figure 3:
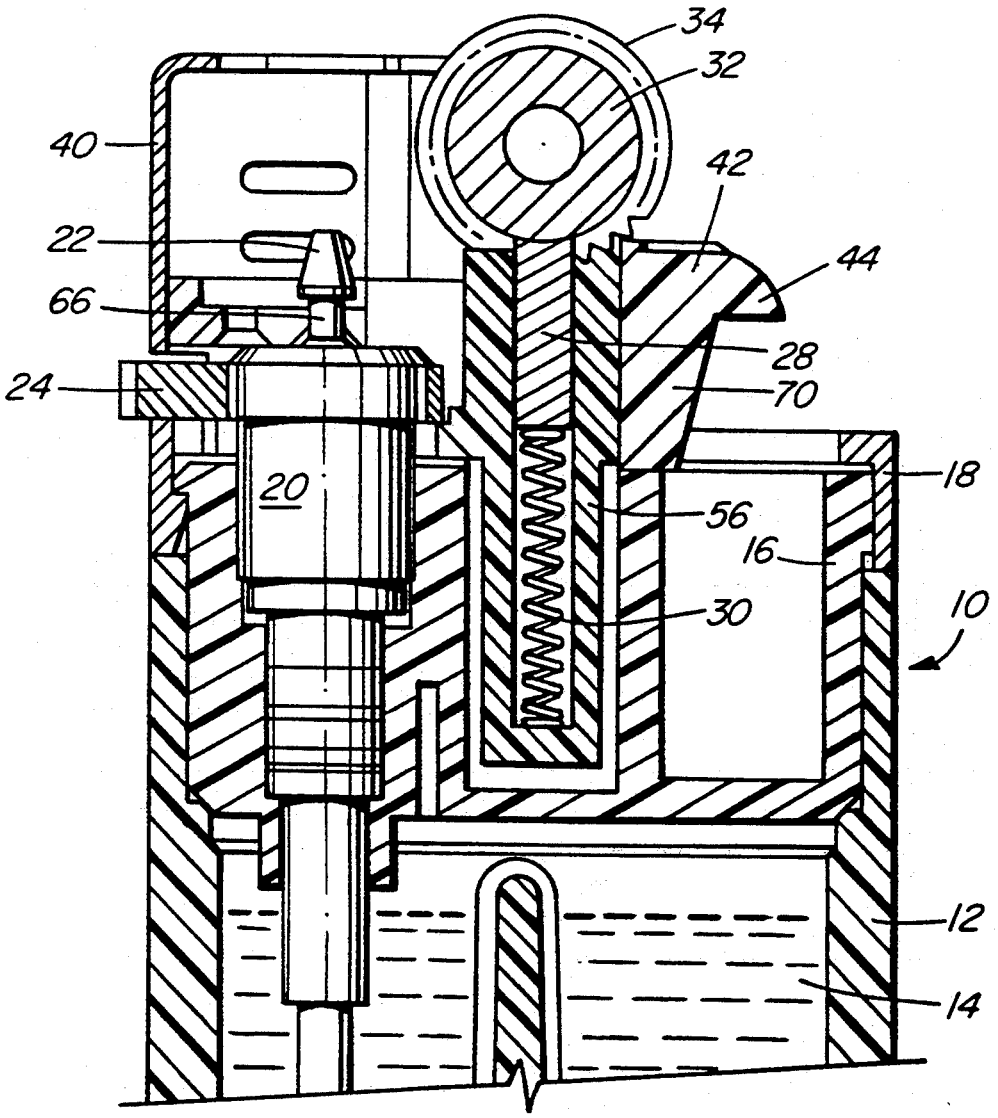
FIGS. 3 to 5 show broken-away views taken in vertical cross-section through parts of a lighter incorporating the lever of FIG. 1.
Figure 4:
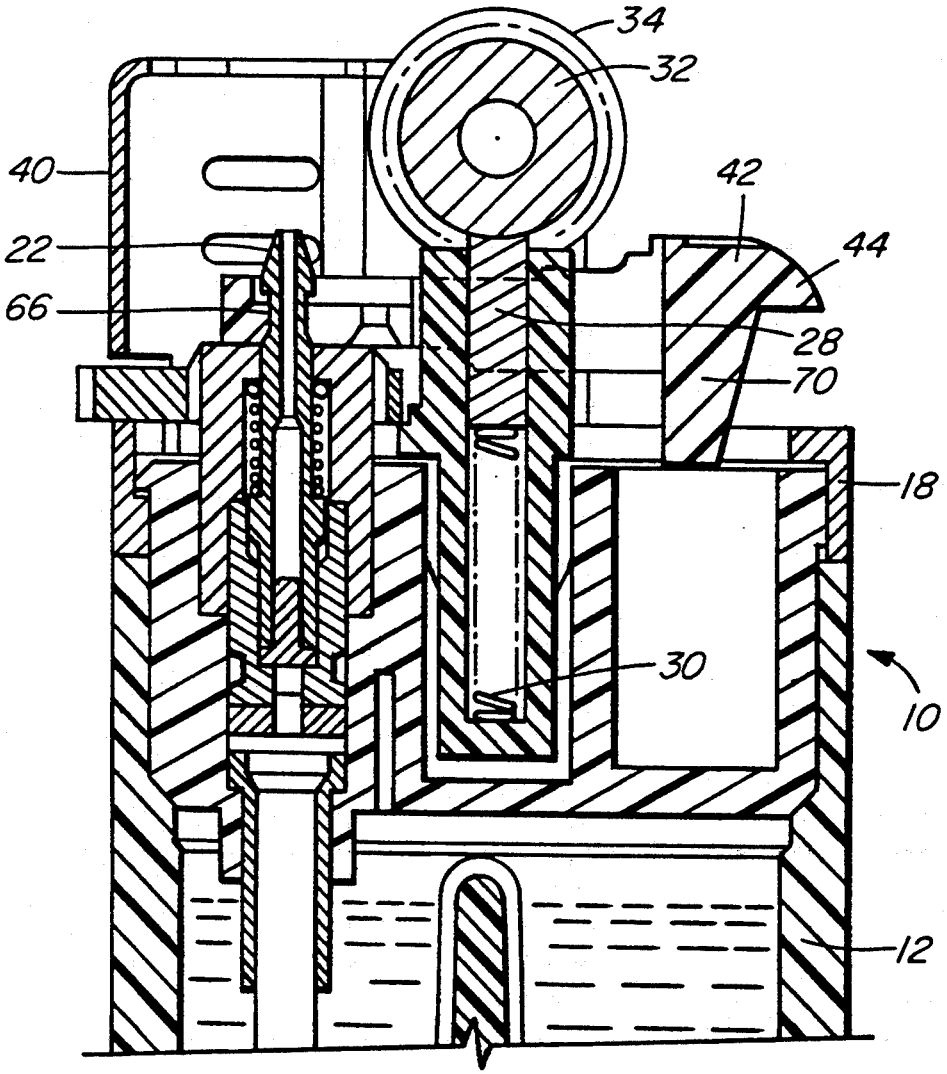
Figure 5:
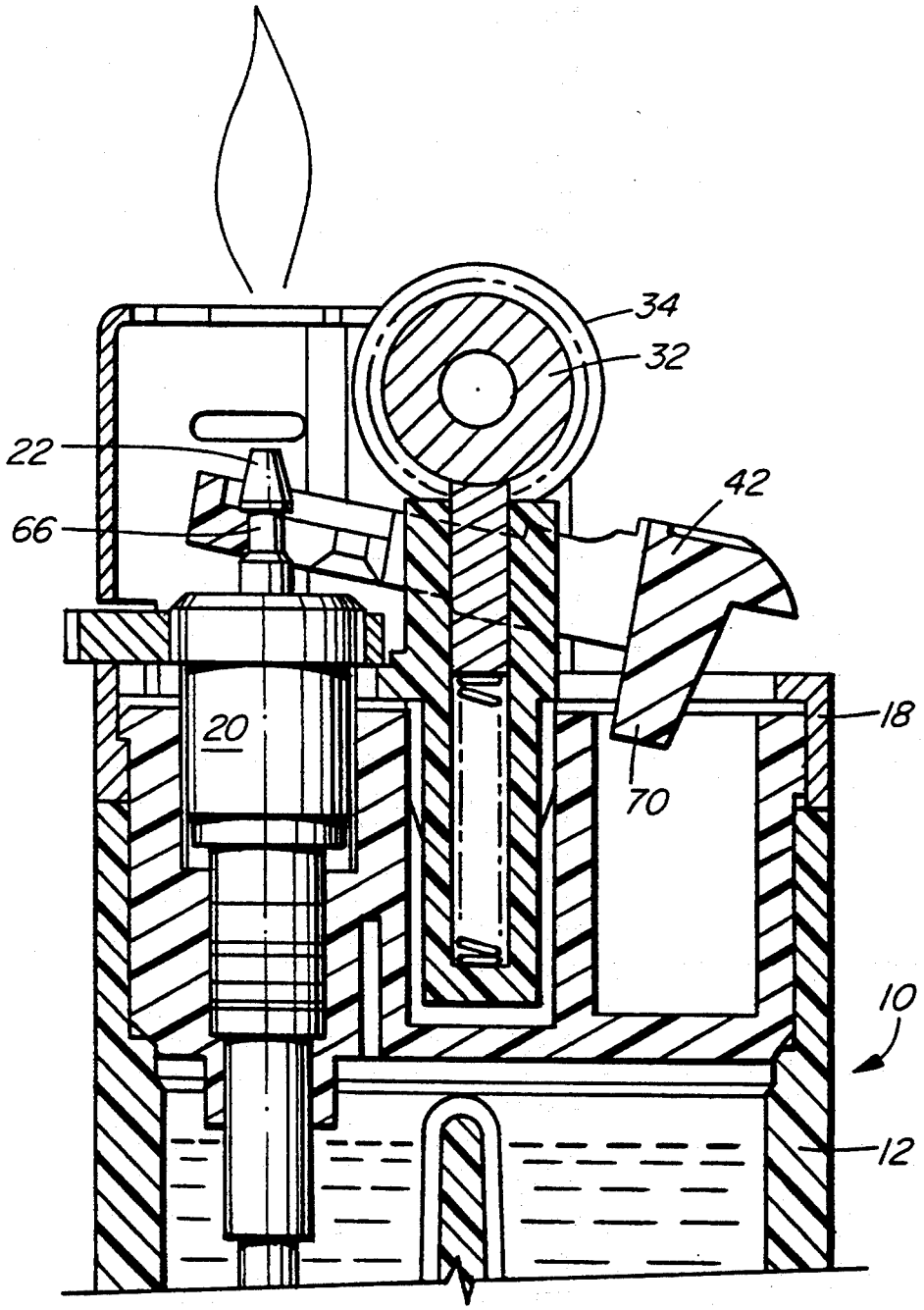

As shown in FIGS. 3 through 5 of the drawings, a lighter indicated generally by reference numeral 10 has a tank 12 which contains a supply of liquid butane 14. The top of the tank 12 is closed by a tank cover 16, which is welded to the tank 12, and a bracket 18 extends around and over the periphery of the tank cover 16.

A conventional gas valve 20 is mounted in the tank cover 16 and has a nozzle 22 and an adjustment ring 24 for adjusting the valve 20 to thereby correspondingly adjust the height of a flame 26 (FIG. 4) above the nozzle 22, when the lighter is ignited.

A flint 28 is urged upwardly by a helical compression spring 30 against the periphery of a spark wheel 32, which can be rotated by pressure of a user's thumb (not shown) on a side wheel 34 fixed to the spark wheel 32.

A wind cap 40 extends around the nozzle 22 to counteract extinguishment of the flame 26 by the wind.

The above-described components of the lighter 10 are well known to those skilled in the art and, therefore, are not described in greater detail herein.

Figure 1:
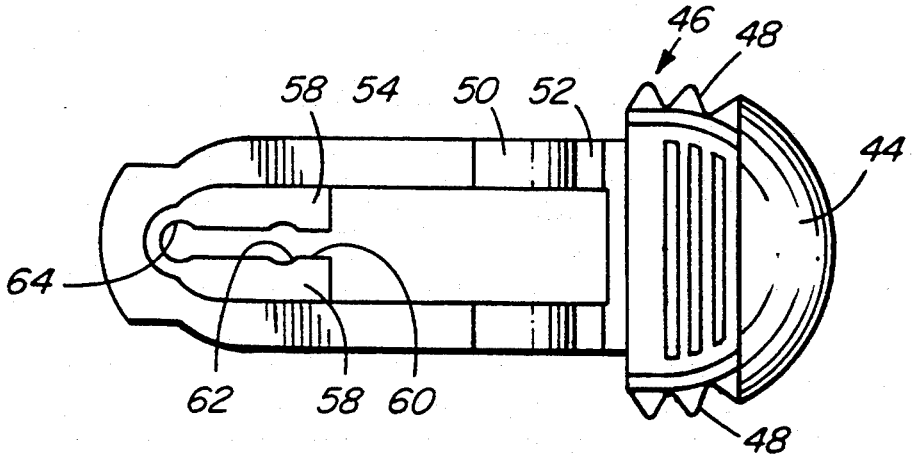
FIG. 1 shows a plan view of an actuating and locking lever forming part of a lighter according to the present invention.
Figure 2:
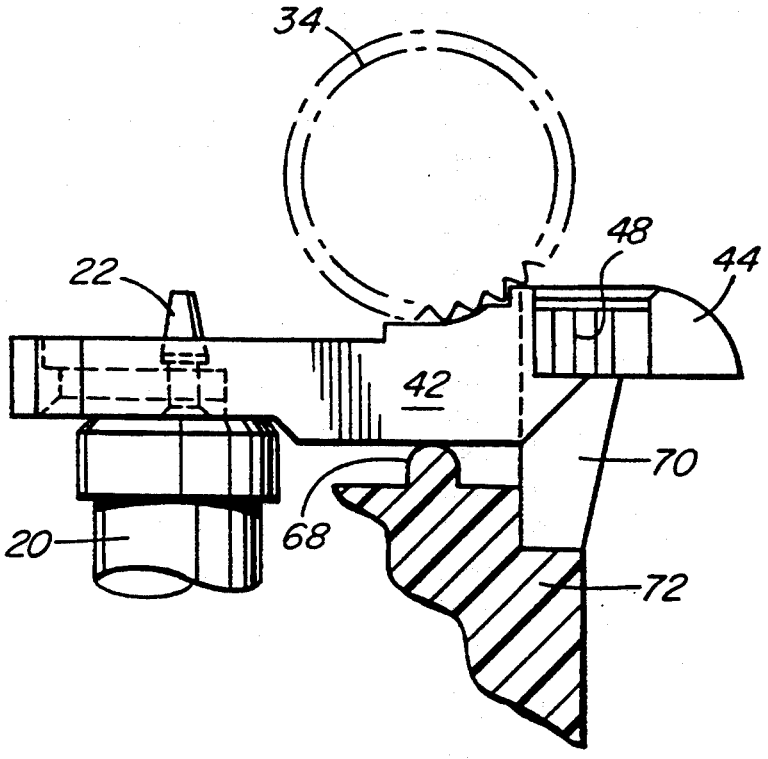
FIG. 2 shows a broken-away view in side elevation of the lever of FIG. 1 and associated components of the lighter.

For raising the nozzle 22 relative to the valve 20 and thereby opening the valve 20 to permit an outflow of butane gas through the nozzle 22, according to the present invention the lighter 10 includes a lever indicated generally by reference numeral 42, which is made of plastic material and which is illustrated in greater detail in FIGS. 1 and 2.

The lever 42 is horizontally displaceable between a locked position, in which it is shown in FIG. 3, and a released position, in which it is shown in FIGS. 4 and 5.

As shown in FIGS. 1 and 2, the lever 42 has a an end position comprising rounded end 44 and an adjacent knurled portion 46 which, at opposite sides of the lever 42, is formed with knurling 48. Adjacent the knurled portion 46, the top of the lever 42 is formed with a ramp or wedge portion 50, which curves downwardly and to the left, as view in FIG. 1 and 2, with a projection in the form of a ridge 52 formed near the top of the ramp portion 50. When the lever 42 is in its locking position, as shown in FIG. 2, the ridge 52 engages the teeth of the side wheel 34 and, thus, prevents rotation of the spark wheel 32.

At its mid-portion, the lever 42 is formed with a rectangular opening 54, through which extends a vertical sleeve 56 (FIG. 3) containing the flint 28 and the compression spring 30.

The left-hand end of the opening 54 is formed with a pair of inwardly projecting detent flanges 58, which are separated by a slot 60 extending longitudinally of the lever 42. The slot 60 is formed with a first circular widened portion 62 and with a second widened portion 64, and the widened portions 62 and 64 serve as detent recesses for resiliently receiving and engaging a neck 66 (FIG. 3) on the nozzle 22 in order to thereby releasably retain the lever 42 in its locked position and its released position, respectively.

In its released position, in which the nozzle neck 66 is engaged in the widened portion 64, the lever 42 can be pivoted about a projections 68 provided on the tank cover 16 at opposite sides of the sleeve 56 and forming a fulcrum for the pivotation of the lever 42. However, when the lever 42 is displaced to the left, into the locked position in which it is shown in FIGS. 2 and 3, and in which the nozzle neck 66 is releasably engaged in the widened portion 62 of the slot 60, a downwardly extending projection 70 at the underside of the lever 42 is located in abutment with a retainer in the form of a shoulder 72 on the tank cover 16, which prevents the pivotation of the lever 42 about the projections 68. Also, in this locked position of the lever 42, the wedge portion 46 is wedged between the fulcrums 68 and the side wheels 34.

To release the lever 42, the user engages the side knurling 48 on the lever 42 between his thumb and forefinger and then pulls the lever 42 to the fight as viewed in the drawings, to move the lever 42 into the released position in which it is shown in FIG. 4 and 5. The displacement of the lever 42 moves the nozzle neck 66 from the slot widened portion 62 to the widened portion 64 and, also, displaces the downwardly projecting portion 70 of the lever 42 from the abutment shoulder 72. The rounded end 44 of the lever 42 can then be depressed by the user's thumb so as to cause the lever 42 to pivot in a clockwise direction, as viewed in FIG. 5, about the projections 68 to raise the nozzle 22 and, thereby, to open the valve 20. Simultaneously, the user's thumb rotates the side wheel 34 and, thus, the spark wheel 32, in conventional manner, so as to produce a spark for igniting the butane gas flowing out from the nozzle 22.

When the lighter is no longer in use, the user employs his thumb to exert a pressure on the rounded end 44 of the lever 42 so as to displace the lever 42 longitudinally and horizontally to the left, as viewed in the drawings, into its locked position.

When the lever 42 is in its locked position, the lever 42 functions as a resilient clamp and exerts a clamping force on the nozzle 22 of the valve 20. The wedge portion 50 of the lever 42 functions as a wedge, the ridge 52 on the lever 42 engaging the side wheels 34 for preventing the latter from turning.

The rounded end 44 of the lever 42 provides a sliding surface over which the user's thumb can slide downwardly from the lever 42, and the knurling 48 on opposite sides of the lever 42 facilitates gripping of the lever 42 between the user's thumb and forefinger. When the user pulls the lever 42 to the right, as viewed in the drawings, from its locked position to its unlocked position, he exerts a horizontal pulling force which must be sufficient to overcome the clamping force exerted by the lever 42 on the neck 66 of the nozzle 22, the friction between the lever 42, the fulcrum 68 and the spark wheels 34 and the friction between the downwardly extending projection 70 and the tank cover shoulder 72. These forces can be predetermined by adjustment of the tolerances of the fit between the lever 42 and the other components of the lighter. These tolerances are selected so that the force required to displace the lever 42 from its locked position to its unlocked position is greater than that which can be exerted by a child, so that the child cannot release and ignite the lighter.

As will be apparent to those skilled in the art, various modifications may be made in the abovedescribed lighter within the scope of the appended claims.

I claim:

1. A child resistant lockable lighter, comprising:

a fuel tank;

a cover on said tank;

a valve mounted on said cover;

said valve including a gas outlet nozzle for the outflow of gas from said lank under the control of said valve;

a spark wheel, a flint and a sprint urging said flint against said spark wheel to produce a spark on rotation of said spark wheel;

a lever for operating said valve; and a fulcrum for said lever;

said lever being displaceable between a locked position, in which said lever maintains said valve in a closed condition, and a released position, in which said lever is free to pivot about said fulcrum to thereby open said valve;

a retainer engageable with said lever to prevent pivotation of said lever about said fulcrum on displacement of said lever into said locked position;

said nozzle having a neck;

said lever being formed with a slot slidably receiving said neck; and said slot having first and second widened portions for resiliently engaging said neck and thereby releasably retaining said lever in its locked position and its released position, respectively.

2. A child-resistant lockable lighter, comprising:

a fuel tank;

a cover on said tank;

a valve mounted on said cover;

said valve including a gas outlet nozzle for the outflow of gas from said tank;

a spark wheel, a flint and a spring urging said flint against said spark wheel to produce a spark on rotation of said spark wheel;

a fulcrum;

a lever pivotable on said fulcrum for opening said valve;

said lever being longitudinally slidable between a released position, in which said lever is free to pivot about said fulcrum to thereby open said valve, and a locked position;

an abutment engageable with said lever to prevent pivotation of said lever about said fulcrum on displacement of said lever into said locked position; and a detent mechanism for releasably retaining said lever in its locked position;

said nozzle having a neck;

said detent mechanism comprising a slot slidably receiving said neck; and said slot having first and second widened portions for resiliently engaging said neck and thereby releasably retaining said lever in its locked position and its released position, respectively.

3. A child-resistant lockable lighter, comprising:

a fuel tank;

a cover on said tank;

a valve mounted on said cover;

said valve including a gas outlet nozzle for the outflow of gas from said tank under the control of said valve;

a spark wheel, a side wheel for rotating said spark wheel, a flint and a spring urging said flint against said spark wheel to produce a spark on rotation of said spark wheel;

a lever for operating said valve; and a fulcrum for said lever;

said lever being longitudinally displaceable to and fro between a locked position, in which said lever maintains said valve in a closed condition, and a released position, in which said lever is free to pivot about said fulcrum to thereby open said valve;

an abutment engageable with an underside of one end portion of said lever on displacement of said lever into said locked position for preventing pivotation of said lever about said fulcrum;

said lever including a wedge-shaped portion on top of said lever, said wedge-shaped portion being movable into wedging engagement between said fulcrum and said side wheel on displacement of said lever into its locked position;

said lever further comprising a projection engageable with said side wheel for retaining said spark wheel from rotation; and a detent at an opposite end portion of said lever for releasibly retaining said lever in its locked position whereby said lever is releasibly restrained from its to and from movement and from pivotation when in its locked position;

said lever being formed with a slot slidably receiving said nozzle, and said detent comprising one of a pair of widened portions of said slot for resiliently engaging said nozzle and thereby releasibly retaining said lever in its locked position and its released position, respectively.

4. A child-resistant lockable lighter, comprising:

a fuel tank;

a cover on said tank;

a valve mounted on said cover;

said valve including a gas outlet nozzle for the outflow of gas from said tank under the control of said valve;

a spark wheel, a side wheel for rotating said spark wheel, a flint and a spring urging said flint against said spark wheel to produce a spark on rotation of said spark wheel;

a lever for operating said valve; and a fulcrum for said lever;

said lever being longitudinally displaceable to and fro between a locked position, in which said lever maintains said valve in a closed condition, and a released position, in which said lever is free to pivot about said fulcrum to thereby open said valve;

an abutment engageable with an underside of one end portion of said lever on displacement of said lever into saint locked position for preventing pivotation of said lever about said fulcrum;

said lever including a wedge-shaped portion on top of said lever, said wedge-shaped portion being movable into wedging engagement between said fulcrum and said side wheel on displacement of said lever into its locked position;

said lever further comprising a projection engageable with said side wheel for retaining said side wheel from rotation; and a detent at an opposite end portion of said lever for releasibly retaining said lever in its locked position, whereby said lever is releasibly restrained from its longitudinal to and from movement and from pivotation when in its locked position.

5. A child-resistant lockable lighter as claimed in claim 4, wherein said first-mentioned end portion of said lever is knurled at opposite sides.

6. A child-resistant lockable lighter as claimed in claim 5, wherein said first-mentioned end portion includes a rounded end.

* * * * *